US010961048B2

(12) United States Patent
Hindbo

(10) Patent No.: US 10,961,048 B2
(45) Date of Patent: Mar. 30, 2021

(54) BLADDER FOR RETAINING MATERIAL IN A BLADDER TANK

(71) Applicant: THINK TANK PRODUCTS INC., Olds (CA)

(72) Inventor: Monte W. Hindbo, Olds (CA)

(73) Assignee: Think Tank Products Inc., Alberta (CA)

( * ) Notice: Subject to any disclaimer, the term of this patent is extended or adjusted under 35 U.S.C. 154(b) by 62 days.

(21) Appl. No.: 15/968,826

(22) Filed: May 2, 2018

(65) Prior Publication Data

US 2018/0319586 A1 Nov. 8, 2018

Related U.S. Application Data

(60) Provisional application No. 62/501,179, filed on May 4, 2017.

(51) Int. Cl.

| | |
|---|---|
| ***B65D 90/24*** | (2006.01) |
| ***B65D 88/08*** | (2006.01) |
| ***B65D 90/04*** | (2006.01) |

(52) U.S. Cl.

CPC ..... *B65D 90/24* (2013.01); *B65D 88/08* (2013.01); *B65D 90/046* (2013.01); *B65D 2590/046* (2013.01); *B65D 2590/24* (2013.01)

(58) Field of Classification Search

CPC .. B65D 90/024; B65D 90/046; B65D 90/048; B65D 88/1618; B65D 88/1656; B65D 90/24; B65D 88/1643; B65D 33/00; B65D 33/02; B65D 29/02

See application file for complete search history.

(56) References Cited

U.S. PATENT DOCUMENTS

| | | | | |
|---|---|---|---|---|
| 5,562,369 | A * | 10/1996 | Jones | B65D 88/72 406/90 |
| 6,322,303 | B1 * | 11/2001 | John | B60P 7/065 410/119 |
| 2013/0142456 | A1 * | 6/2013 | Joshi | B65D 88/1656 383/95 |
| 2014/0133951 | A1 * | 5/2014 | Thomas | B65D 88/1606 414/800 |

* cited by examiner

*Primary Examiner* — Andrew T Kirsch
(74) *Attorney, Agent, or Firm* — Crowe & Dunlevy, P.C.

(57) ABSTRACT

A bladder for retaining material to be stored within a bladder tank. The bladder comprises a flexible enclosure comprising a floor portion connected to one or more wall portions, and a leak retention enclosure having upper and lower edges sealed to the flexible enclosure to create a sealed chamber between the flexible enclosure and the leak retention enclosure. Leakage of material from within the flexible enclosure adjacent to the sealed chamber is received within the sealed chamber and retained by the leak retention enclosure.

4 Claims, 4 Drawing Sheets

BLADDER FOR RETAINING MATERIAL IN A BLADDER TANK

CROSS REFERENCE TO RELATED APPLICATIONS

The application claims the benefit of and priority to U.S. Provisional Patent Application No. 62/501,179, filed May 4, 2017, and incorporates by reference said provisional application in its entirety.

BACKGROUND OF THE INVENTION

1. Field of the Invention

This invention relates generally to the field of vessels that may be used to contain fluids, bulk solids and other materials, and in particular to a bladder for retaining material in such vessels.

2. Description of the Related Art

The containment vessels, or tanks as they are sometimes referred to, are used in a wide variety of different industries and industrial, commercial and residential applications to contain fluids (including liquids and/or gases), granular solid material, etc. One particular form of such a containment vessel or tank comprises a rigid enclosure (commonly generally round in horizontal section) having an internal bladder that holds the material in question. The rigid enclosure provides structural support, whereas the bladder "contains" the material for storage in a manner that preserves its purity and integrity, and that limits exposure to the environment. Such vessels or tanks have proven to be advantageous on account of their relatively light weight, and their ease of assembly and disassembly for movement from location to location. Once assembled, the product to be stored can be pumped or otherwise conveyed into the bladder. As material is deposited into the bladder, the bladder fills the available space provided by the walls of the enclosure. When required, the material within the bladder can be pumped, drained or otherwise conveyed out of the bladder. The types of materials that can be stored in such tanks is extremely broad and can include, amongst other things, water, various gaseous products, liquid or solid food products, grains, industrial metals and minerals, oil, petro-chemicals, etc.

While such bladder tanks or containment vessels have proven to be highly desirable, in some instances it can be difficult to properly seat the bladder within the lower corners of the tank. That is, when inserting the bladder into the assembled tank and thereafter filling the bladder, the lowermost corners of the bladder may not always be received precisely or fully within the bottom corners of the tank. Further, in some instances the dimensions of the bladder and the tank are not perfectly identical such that the bladder is slightly smaller, preventing it from "seating" squarely within the tank's lower corner or corners. In other instances the bladder may not be positioned centrally within the tank, meaning that portions of the bladder around various sides or the bottom surface of the tank may not be in contact with the exterior wall or bottom surface of the tank to the extent necessary to allow the tank to fully seat itself within the interior lower corners of the tank. Other assembly and/or manufacturing inconsistencies could also prevent a proper seating of the bladder tightly against the tank wall and the tank bottom surface.

In any event, when the bladder is not fully in contact with both the bottom surface and the side wall of the tank, an air pocket can exist between the bladder and the tank, causing the bladder to be stressed along that portion that is not in contact with the tank (i.e. that portion not properly seated within the tank's corner). In some instances there may be a lower seam within the bladder relatively close to the bottom of the tank. Where the bladder is not fully seated within the tank's corner that seam may exist in a stressed location along the bladder wall. The bladder wall that is stressed, including any seam that may be stressed, is a potential point where containment may fail and leakage may occur.

It is therefore desirable to provide vessels that may be used to contain fluids, bulk solids and other materials, and in particular to a bladder for retaining material in such vessels.

Before proceeding to a detailed description of the invention, however, it should be noted and remembered that the description of the invention which follows, together with the accompanying drawings, should not be construed as limiting the invention to the examples (or embodiments) shown and described. This is so because those skilled in the art to which the invention pertains will be able to devise other forms of this invention within the ambit of the appended claims.

BRIEF SUMMARY OF THE INVENTION

In general, in one aspect, the invention relates to a bladder for retaining material to be stored within a bladder tank, the bladder comprising a flexible enclosure comprising a floor portion connected to one or more wall portions, and a leak retention enclosure having upper and lower edges sealed to the flexible enclosure to create a sealed chamber between the flexible enclosure and the leak retention enclosure, wherein leakage of material from within the flexible enclosure adjacent to the sealed chamber is received within the sealed chamber and retained by the leak retention enclosure.

The foregoing has outlined in broad terms some of the more important features of the invention disclosed herein so that the detailed description that follows may be more clearly understood, and so that the contribution of the named inventors to the art may be better appreciated. The invention is not to be limited in its application to the details of the construction and to the arrangements of the components set forth in the following description or illustrated in the drawings. Rather, the invention is capable of other embodiments and of being practiced and carried out in various other ways not specifically enumerated herein. Finally, it should be understood that the phraseology and terminology employed herein are for the purpose of description and should not be regarded as limiting, unless the specification specifically so limits the invention.

BRIEF DESCRIPTION OF THE DRAWINGS

These and further aspects of the invention are described in detail in the following examples and accompanying drawings.

DETAILED DESCRIPTION OF THE INVENTION

Figures 1, 2:
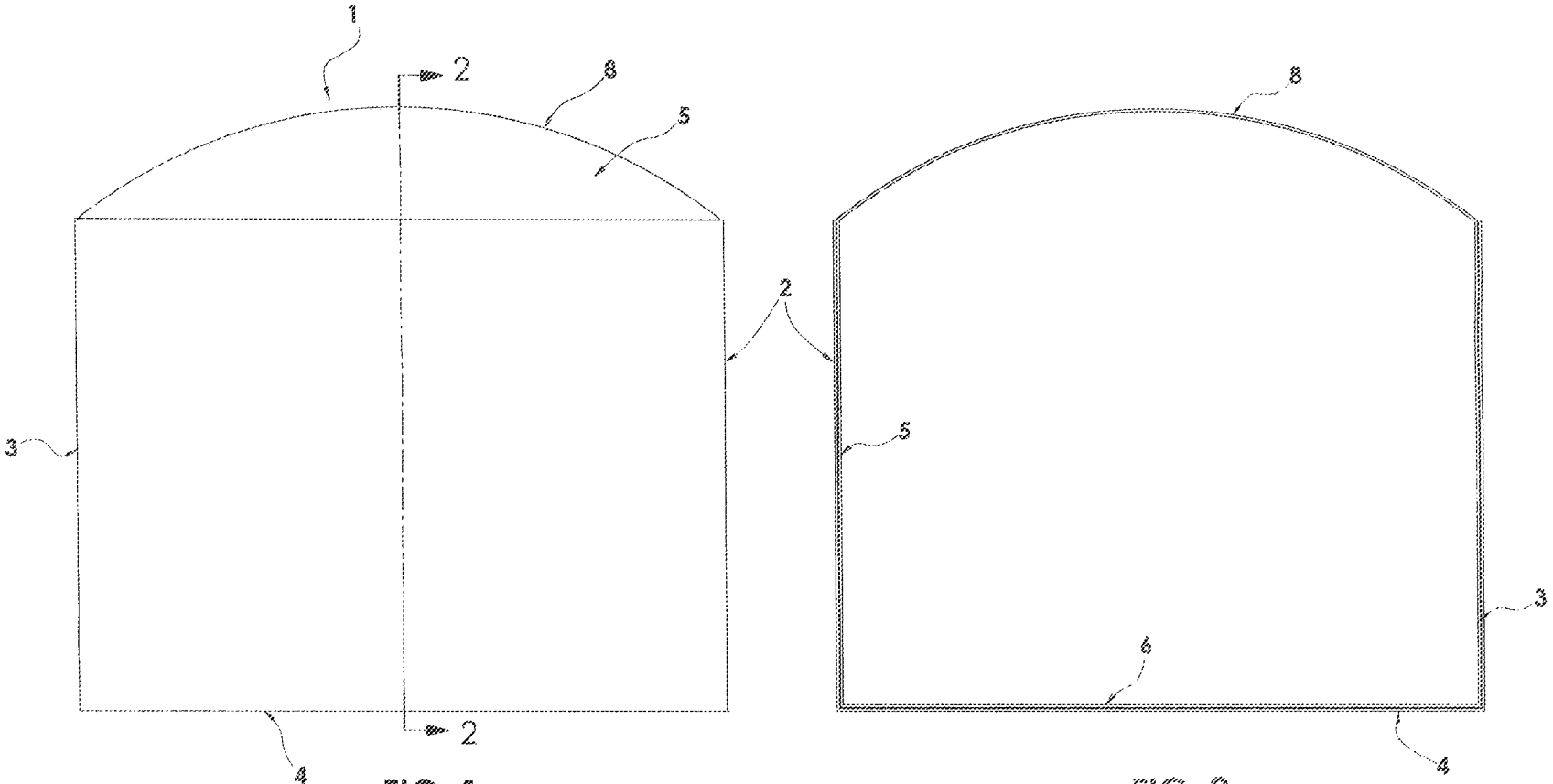
FIG. 1 is a side elevational view of a generic tank or containment vessel containing a bladder for retaining materials therein.
FIG. 2 is a sectional line taken along the line 2-2 of FIG. 1 showing a bladder properly seated within the lower corners of the tank.

While this invention is susceptible of embodiment in many different forms, there is shown in the drawings, and will herein be described hereinafter in detail, some specific embodiments of the invention. It should be understood, however, that the present disclosure is to be considered an exemplification of the principles of the invention and is not intended to limit the invention to the specific embodiments so described.

Referring now to the figures of the drawings, wherein like numerals of reference designate like elements throughout the several views, a typical bladder tank 1 is comprised of a rigid shell 2 having walls 3 and a bottom 4 that converge at a corner 25. Positioned within rigid shell 2 is a bladder 5. In the particular vessel shown, there is not included a rigid or hard top, but rather bladder 5 projects outwardly from the upper sides of walls 3. In the embodiments shown, vessel 1 is also cylindrical in nature having a generally circular horizontal section. It will be appreciated that other shapes of vessels are possible and may be desirable in some applications.

As is understood in the art, bladder 5 will be of a nature such that it can be folded or collapsed for transport and storage. When it is desirable to retain material within vessel 1, material can be pumped or otherwise delivered into the sealed interior of bladder 5 causing the bladder to be filled and expanded within the confines of rigid shell 2. To that end, bladder 5 will generally be comprised of a flexible enclosure that is defined generally by a floor portion 6 connected to one or more wall portions 7, that are in turn connected to an enclosed top 8. An opening or fitting (not shown) is commonly positioned within walls 7 or top 8 in order to permit the bladder to be filled with material, or to permit material to be evacuated from the bladder. Typically a hose, pipe or conduit would be connected to the opening or fitting for filling and evacuation of the bladder.

FIG. 2 shows in vertical section, a bladder within a containment vessel or bladder tank, where the bladder has been properly and fully seated within the vessel such that the juncture of floor portion 6 and walls 7 of bladder 5 is received at (or substantially at) the interior lower corner of shell 2. In this manner, pressure applied to the bladder by materials received therein does not exert undue stress to the lower portion of the bladder that is seated within the corner of the vessel.

Figure 3:
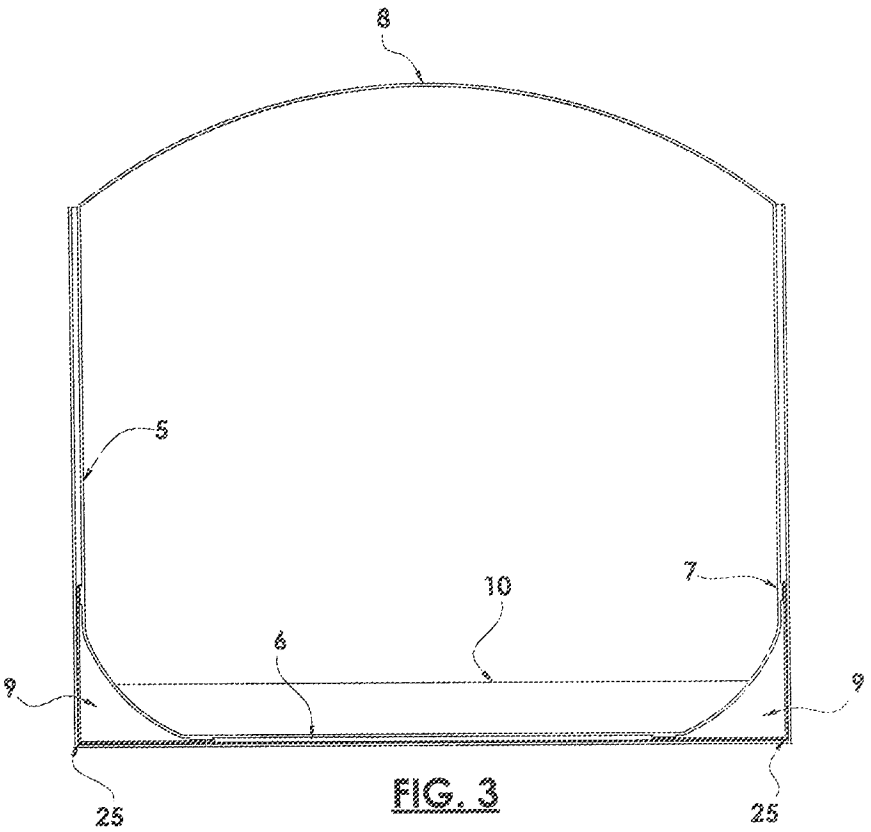
FIG. 3 is a sectional view similar to FIG. 2 wherein the lower corners of the bladder have not been properly seated within the corners of the tank, presenting an air gap between the bladder and the tank.

In contrast, FIG. 3 demonstrates a situation where bladder 5 has not been properly or fully seated within the interior corner of the bladder tank. In this instance it will be appreciated that a gap or air space 9 may exist between bladder 5 and the interior corner of the tank. When bladder 5 is filled, that portion of the bladder that does not contact either the walls 3 or the bottom 4 of rigid shell 2 will be subjected to increased strain, which could potentially lead to failure and leakage. In the case of the embodiment shown in FIG. 3, a seam 10 exists in the bladder at the point where air space or air pocket 9 is created on account of an improper or an incomplete seating of the bladder. It will be appreciated that where seam 10 exists in air space 9, the seam will also be subjected to increased strain and could represent a site for potential leakage or failure of the bladder.

Figure 4:
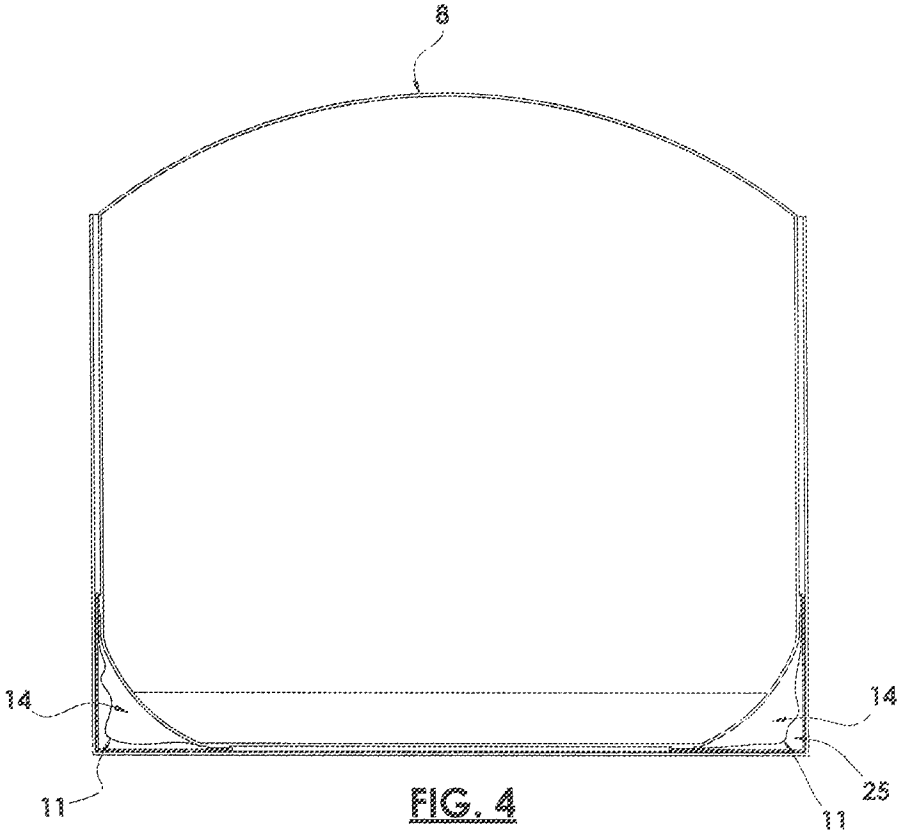
FIG. 4 is a sectional view similar to FIG. 3 wherein the bladder is constructed in accordance with an illustrative embodiment of the invention disclosed herein.
Figure 5:
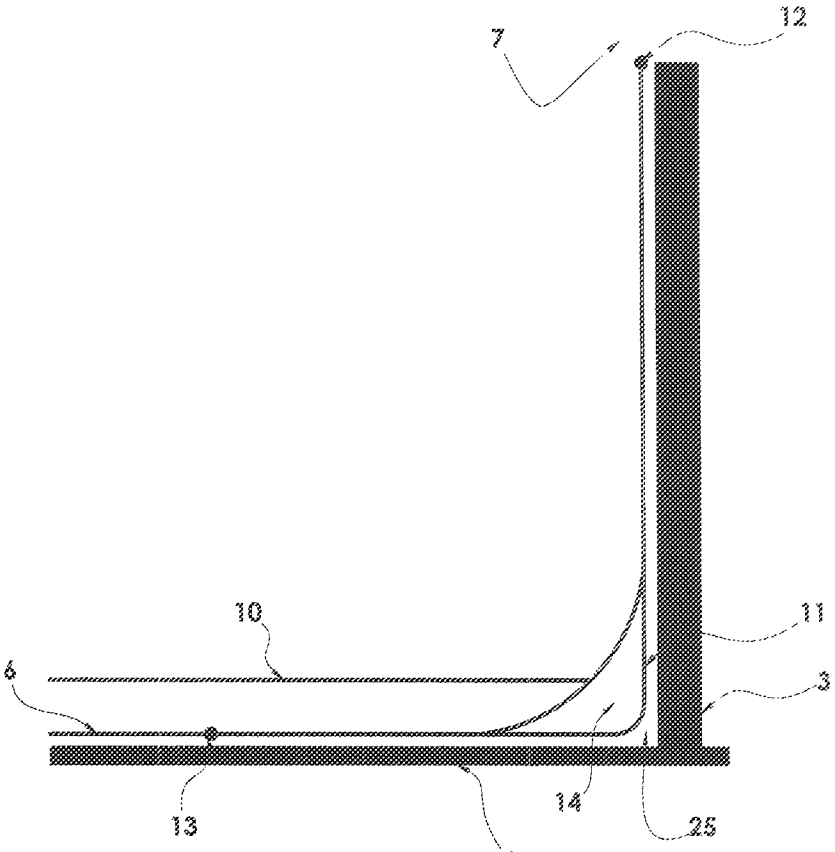
FIG. 5 is an enlarged detail view of a lower corner of the tank shown in FIG. 4.

In accordance with the invention, there is provided a leak retention enclosure 11 that encompasses at least a portion of the exterior surface of bladder 5. It is expected that in most instances leak retention enclosure 11 will be formed from the same flexible material as bladder 5, having an upper edge 12 and a lower edge 13 sealed to the exterior wall of bladder 5. As shown in FIG. 4, leak retention enclosure 11 is preferably sealed about the exterior of bladder 5 at the location where bladder 5 is received within lower corner 25 of rigid shell 2. Leak retention enclosure 11 preferably extends about the entire circumference of bladder 5 in generally a horizontal plane such that it encompasses the entirety of that portion of the bladder adjacent to the lower corner (or corners) of rigid shell 2. The space between the exterior of bladder 5 and the interior of leak retention enclosure 11 will effectively form a circumferential sealed chamber or pocket 14. It will be appreciated that pocket 14 will present a means to contain fluid or other material that may leak from bladder 5 on account of increased strain when the bladder is not fully and properly seated within the lower corner of rigid shell 2. That is, leak retention enclosure 11 provides a secondary containment mechanism that will help contain the contents of bladder 5 should a failure occur in the bladder along its surface that is contiguous with pocket 14.

Whereas in the attached drawings leak retention enclosure 11 is shown as being secured about bladder 5 in a position adjacent to the lower corner of rigid shell 2, in other instances it may be desirable to enlarge or alter the size of leak retention enclosure 11 to encompass additional seams in bladder 5 that may have an enhanced potential for failure. It will also be appreciated that the edges of leak retention enclosure 11 can be sealed to the exterior surface of bladder 5 through a number of different mechanisms including but not limited to heat welding, through the use of adhesives, through mechanical fasters, etc.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

It is to be understood that were the specification or claims refer to relative terms, such as "front," "rear," "lower," "upper," "horizontal," "vertical," "above," "below," "up," "down," "top," "bottom," "left," and "right" as well as derivatives thereof (e.g., "horizontally," "downwardly," "upwardly" etc.), such reference is used for the sake of clarity and not as terms of limitation, and should be construed to refer to the orientation as then described or as shown in the drawings under discussion. These relative terms are for convenience of description and do not require that the apparatus be constructed or the method to be operated in a particular orientation. Terms, such as "connected," "connecting," "attached," "attaching," "join" and "joining" are used interchangeably and refer to one structure or surface being secured to another structure or surface or integrally fabricated in one piece.

For purposes of the instant disclosure, the term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

Methods of the instant disclosure may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Still further, additional aspects of the instant invention may be found in one or more appendices attached hereto and/or filed herewith, the disclosures of which are incorporated herein by reference as if fully set out at this point.

Thus, the invention is well adapted to carry out the objects and attain the ends and advantages mentioned above as well as those inherent therein. While the inventive concept has been described and illustrated herein by reference to certain illustrative embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A bladder for retaining material to be stored within a bladder tank, the bladder comprising:

a flexible enclosure having a floor portion sealingly connected to one or more wall portions along one or more seams, and a leak retention enclosure having upper and lower edges, said upper edge sealed to said one or more wall portions and said lower edge sealed to said floor portion to create a sealed chamber about said one or more seams and exterior to the flexible enclosure, wherein leakage of material through said one or more seams to a point exterior to the flexible enclosure is received within said sealed chamber and retained by said leak retention enclosure at a position exterior to the flexible enclosure.

2. The bladder as claimed in claim 1 wherein said leak retention enclosure is formed from the same material as said flexible enclosure.

3. The bladder as claimed in claim 1 wherein the bladder tank is generally circular in horizontal section, said flexible enclosure is generally circular in horizontal section, and said leak retention enclosure comprises a generally circular member circumventing said flexible enclosure about said one or more seams.

4. The bladder as claimed in claim 1 wherein said leak retention enclosure is heat sealed, sonically welded, or sealed to said flexible enclosure by an adhesive.

* * * * *